US008111868B2

(12) United States Patent
Kaiya

(10) Patent No.: US 8,111,868 B2
(45) Date of Patent: Feb. 7, 2012

(54) SPEAKER DEVICE

(75) Inventor: Teruaki Kaiya, Tendo (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 597 days.

(21) Appl. No.: 12/373,642

(22) PCT Filed: Aug. 24, 2006

(86) PCT No.: PCT/JP2006/316576

§ 371 (c)(1),
(2), (4) Date: Jan. 13, 2009

(87) PCT Pub. No.: WO2008/023419

PCT Pub. Date: Feb. 28, 2008

(65) Prior Publication Data

US 2009/0316948 A1 Dec. 24, 2009

(51) Int. Cl.

| | |
|---|---|
| ***H04R 1/00*** | (2006.01) |
| ***H04R 11/02*** | (2006.01) |
| ***H04R 9/06*** | (2006.01) |
| ***H04R 1/20*** | (2006.01) |

(52) U.S. Cl. ..... 381/403; 381/353; 381/396; 381/400; 381/404; 381/405; 381/407; 381/410; 381/412; 381/413; 381/423; 381/424; 181/171; 181/172

(58) Field of Classification Search ..... 381/403
See application file for complete search history.

(56) References Cited

U.S. PATENT DOCUMENTS

| | | | | |
|---|---|---|---|---|
| 4,764,968 | A * | 8/1988 | Kreitmeier | 381/432 |
| 5,323,469 | A * | 6/1994 | Scholz | 381/403 |
| 5,847,333 | A * | 12/1998 | D'Hoogh | 181/171 |
| 6,031,925 | A * | 2/2000 | Shteyn | 381/401 |

(Continued)

FOREIGN PATENT DOCUMENTS

JP 59-174796 A 11/1984

(Continued)

OTHER PUBLICATIONS

International Search Report of PCT/JP2006/316576, Mailing Date of Oct. 3, 2006.

*Primary Examiner* — Charles Garber
*Assistant Examiner* — Pape Sene
(74) *Attorney, Agent, or Firm* — Westerman, Hattori, Daniels & Adrian, LLP

(57) ABSTRACT

A drive cone 11 and a diaphragm 14 are integrally driven by a voice coil 6 movably disposed in a magnetic gap 5. Peripheral edge portions of the drive cone 11 and the diaphragm 14 are supported by a frame 12 via different edge portions 13 and 15, respectively.

The drive cone 11 is provided with a rising-up portion 11*a* which rises up toward an acoustic radiation direction from a inner circumferential end, and a rising-down portion 11*b* which rises down toward a direction reverse to the acoustic radiation direction. An inner circumferential edge of the diaphragm 14 is fixed at an annular top formed between the rising-up portion and the rising-down portion. Moreover, a first rib 11*c* and a second rib 11*d* are formed on the drive cone 11 in such a manner as to rise up toward the acoustic radiation direction integrally with the drive cone. The diaphragm 14 is supported also at the tips of the ribs.

16 Claims, 8 Drawing Sheets

U.S. PATENT DOCUMENTS

| | | | | |
|---|---|---|---|---|
| 6,088,466 | A * | 7/2000 | Proni | 381/397 |
| 6,095,280 | A * | 8/2000 | Proni | 181/171 |
| 6,327,371 | B1 * | 12/2001 | Proni | 381/397 |
| 6,782,114 | B2 * | 8/2004 | Ando et al. | 381/398 |
| 7,185,735 | B2 * | 3/2007 | Sahyoun | 181/157 |
| 7,292,707 | B2 * | 11/2007 | Kreitmeier et al. | 381/398 |
| 7,324,659 | B2 * | 1/2008 | Funahashi et al. | 381/398 |
| 7,515,728 | B2 * | 4/2009 | Kobayashi et al. | 381/398 |
| 2002/0017423 | A1 * | 2/2002 | Kato | 181/161 |
| 2003/0185415 | A1 * | 10/2003 | Funahashi et al. | 381/398 |
| 2004/0240701 | A1 * | 12/2004 | Sahyoun | 381/407 |
| 2005/0111690 | A1 | 5/2005 | Onuma et al. | |
| 2005/0141746 | A1 | 6/2005 | Kobayashi et al. | |
| 2005/0201588 | A1 * | 9/2005 | Funahashi et al. | 381/423 |
| 2005/0207612 | A1 * | 9/2005 | D'Hoogh | 381/423 |
| 2006/0088180 | A1 * | 4/2006 | Kaiya et al. | 381/397 |
| 2006/0177091 | A1 * | 8/2006 | Funahashi | 381/412 |
| 2006/0215871 | A1 * | 9/2006 | Funahashi et al. | 381/396 |
| 2006/0274914 | A1 * | 12/2006 | Horigome et al. | 381/424 |
| 2009/0190793 | A1 * | 7/2009 | Kaiya | 381/398 |

FOREIGN PATENT DOCUMENTS

| | | | |
|---|---|---|---|
| JP | 2004-7332 | A | 1/2004 |
| JP | 2005-159506 | A | 6/2005 |
| JP | 2005-191746 | A | 7/2005 |

* cited by examiner

[Fig. 1]
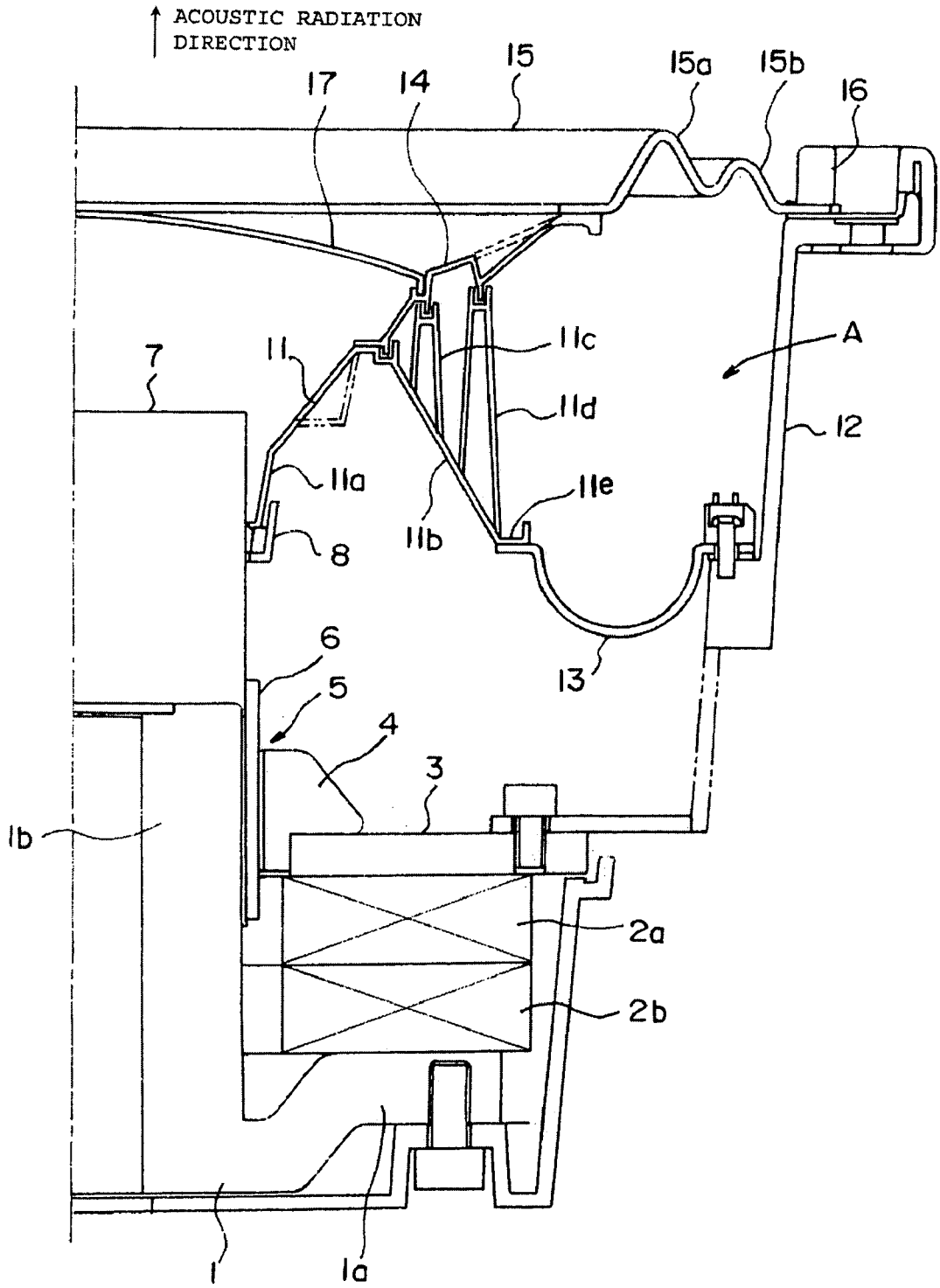

[Fig. 2]
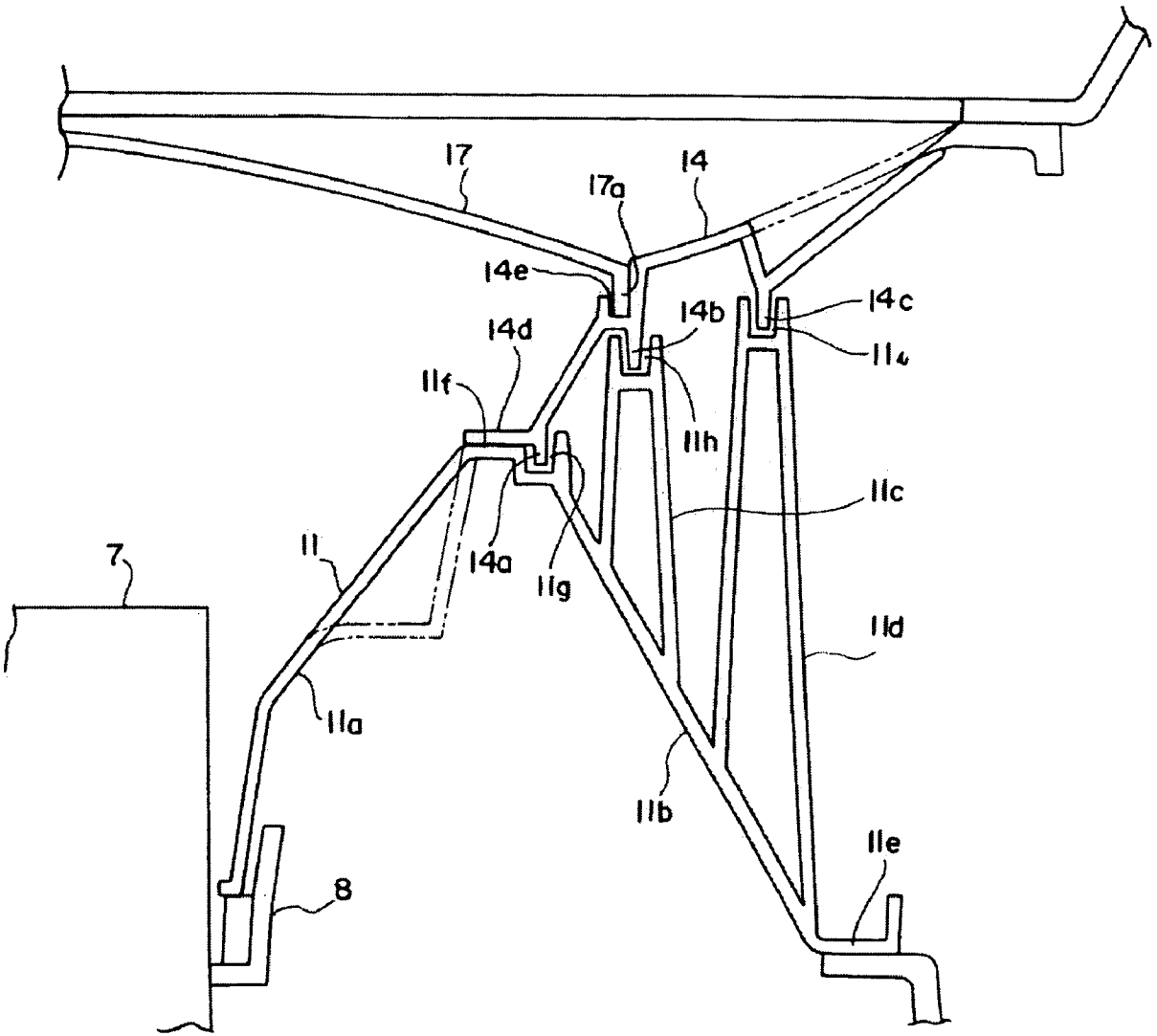

[Fig. 3]
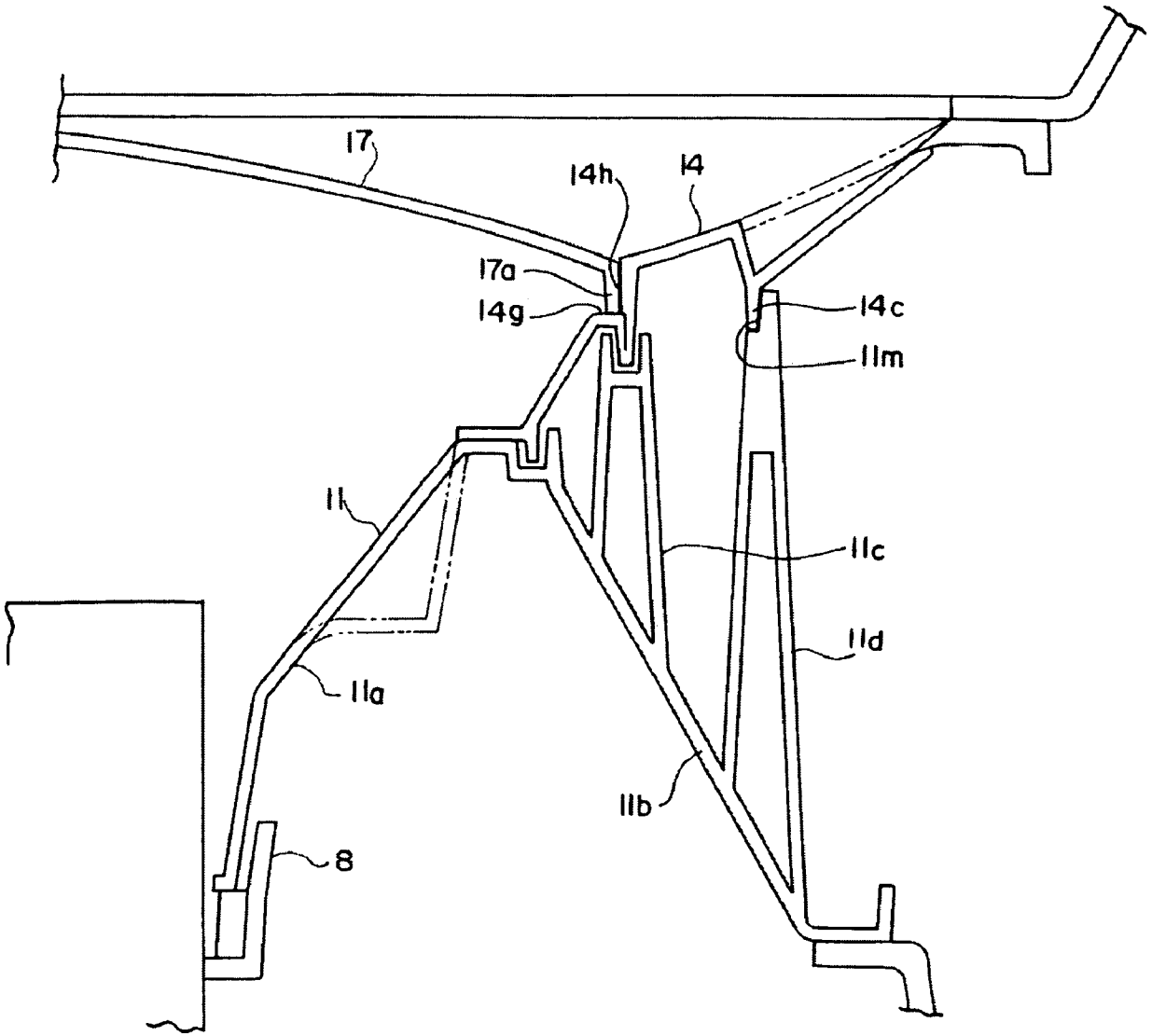

[Fig. 4]
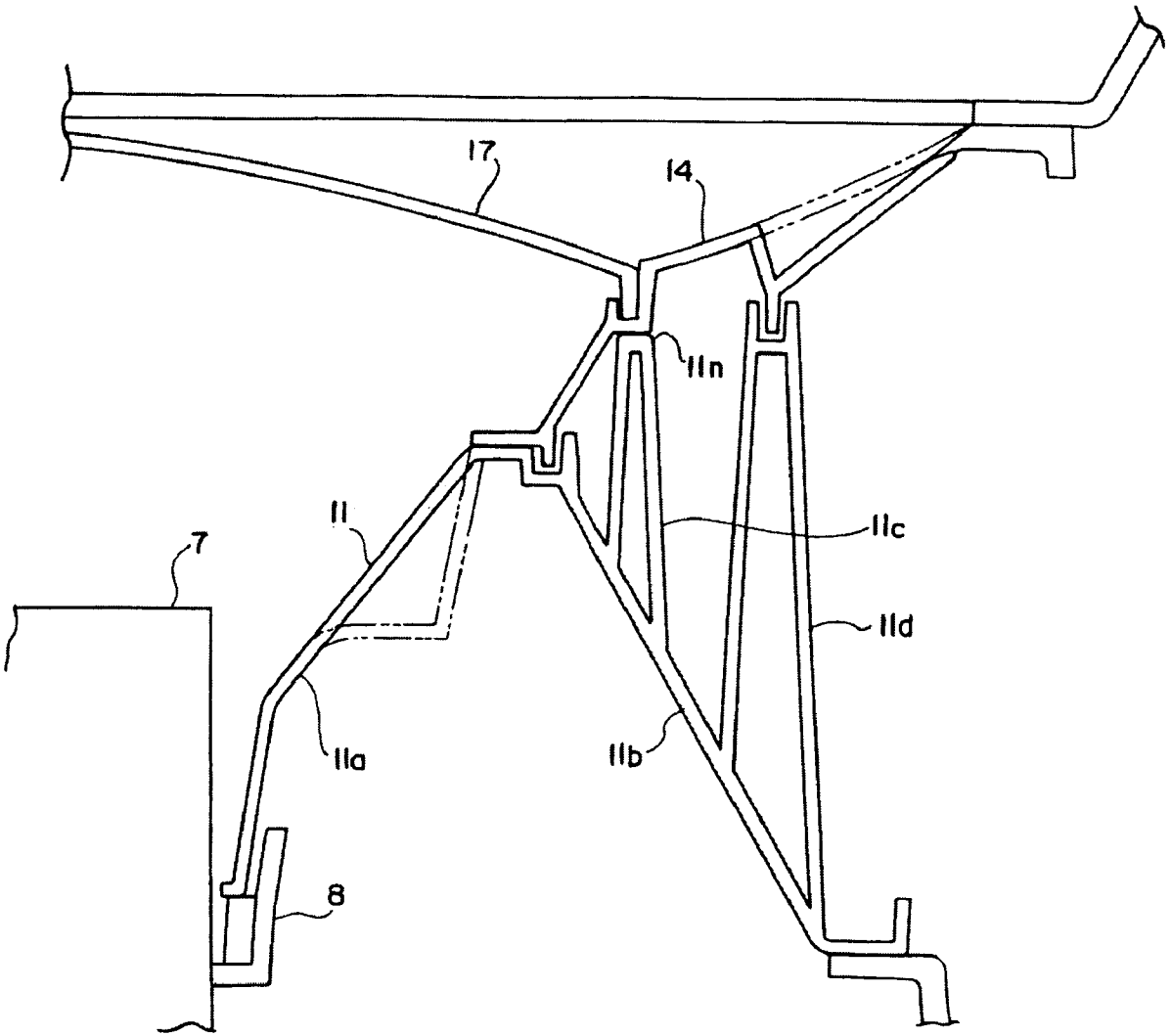

[Fig. 5]
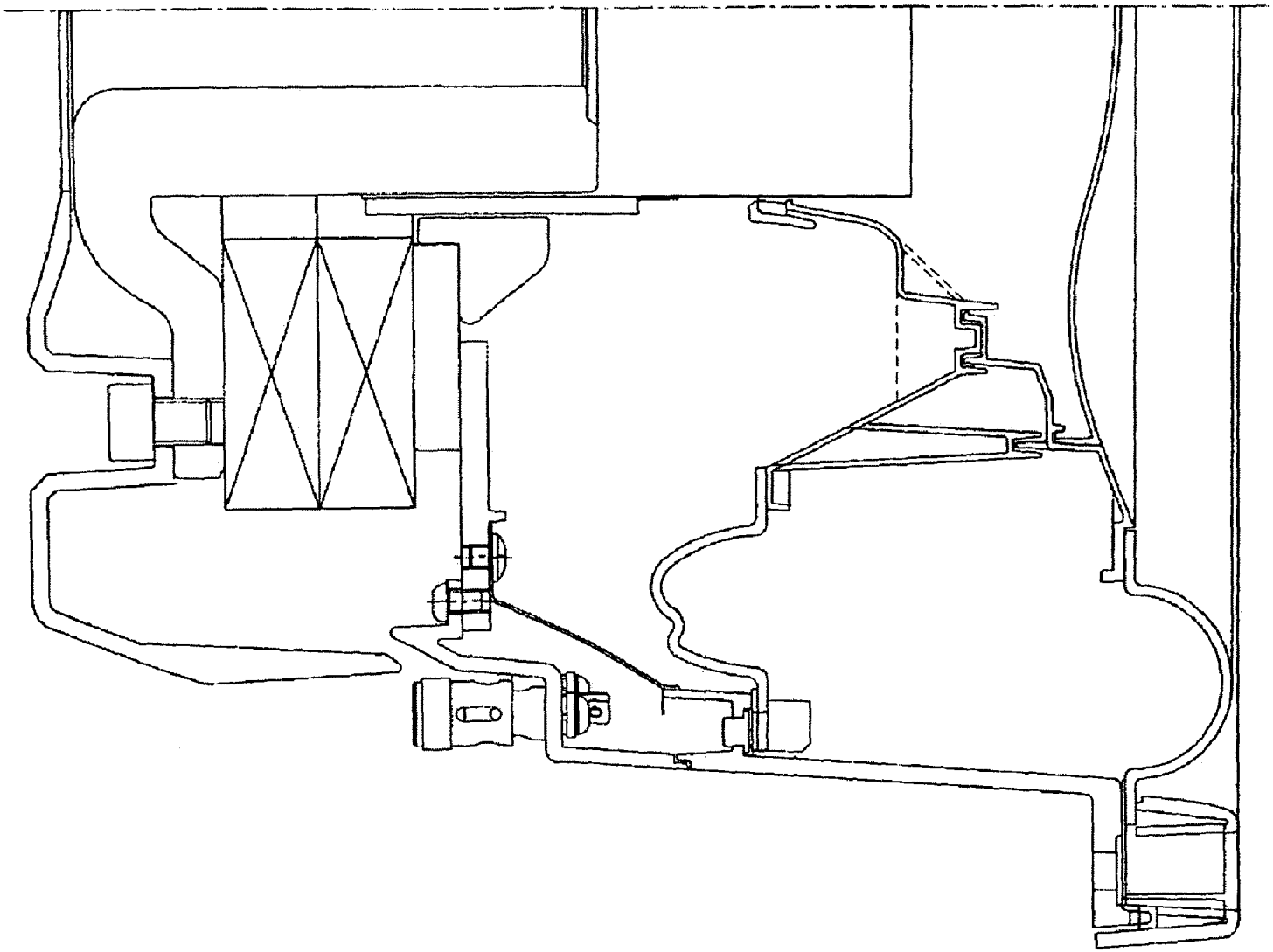

[Fig. 6]
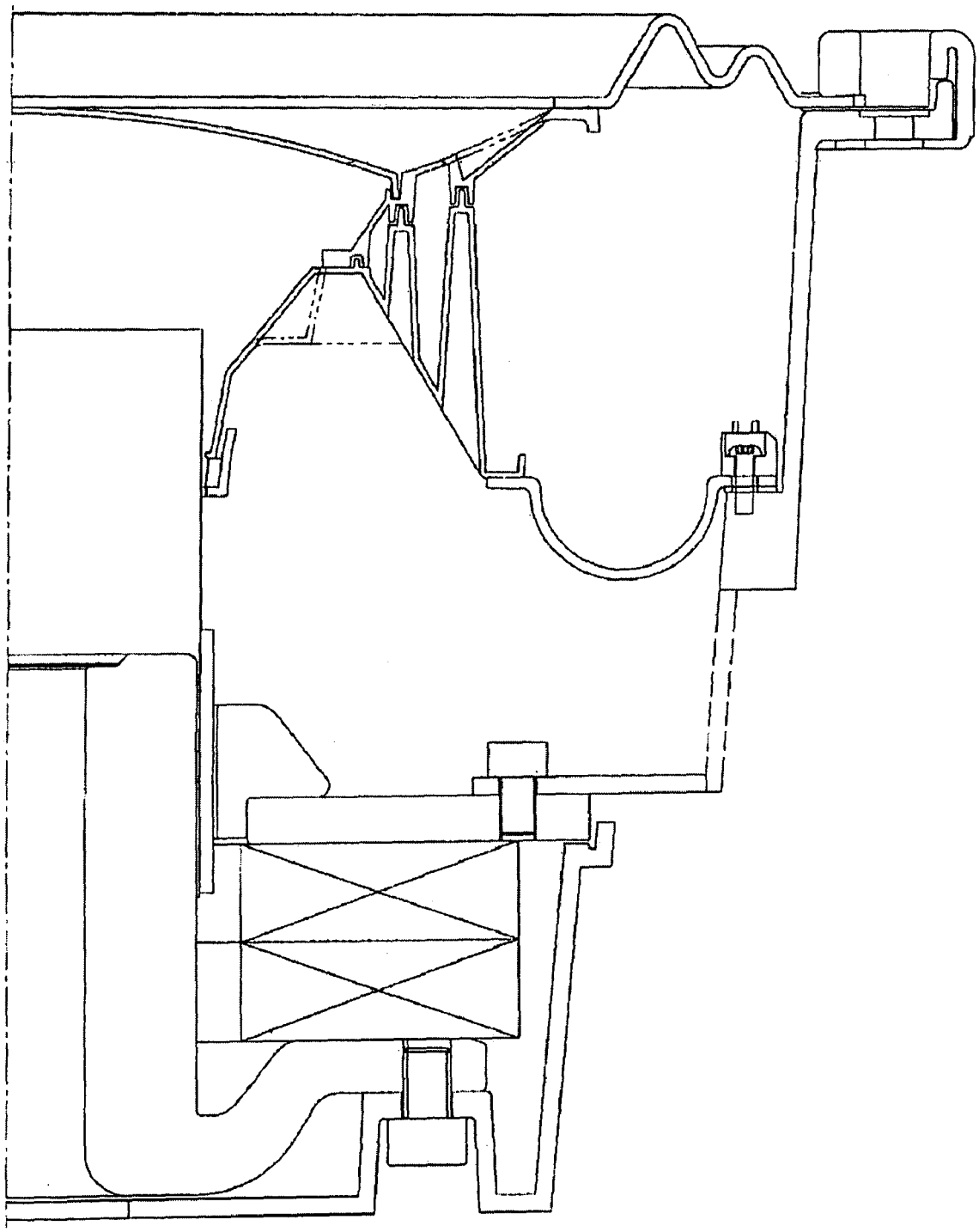

[Fig. 7]
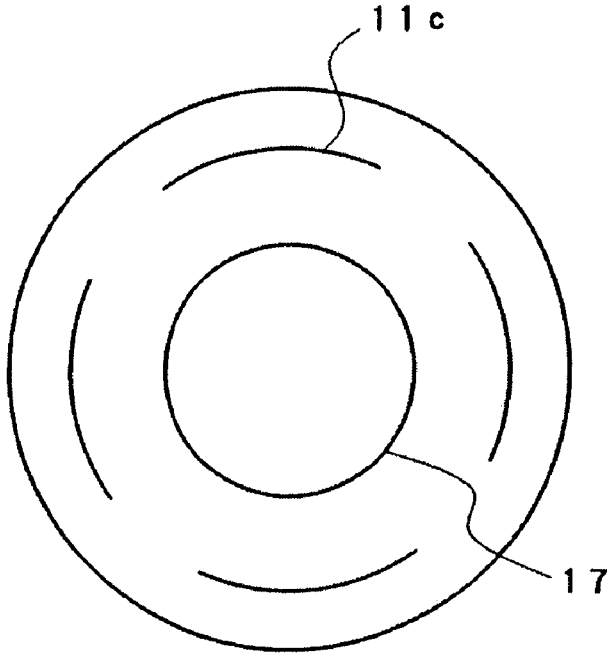
[Fig. 8]
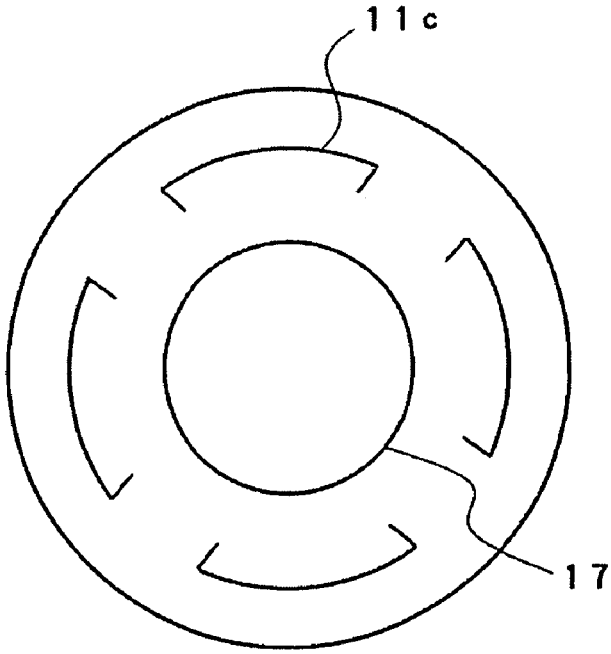

[Fig. 9]
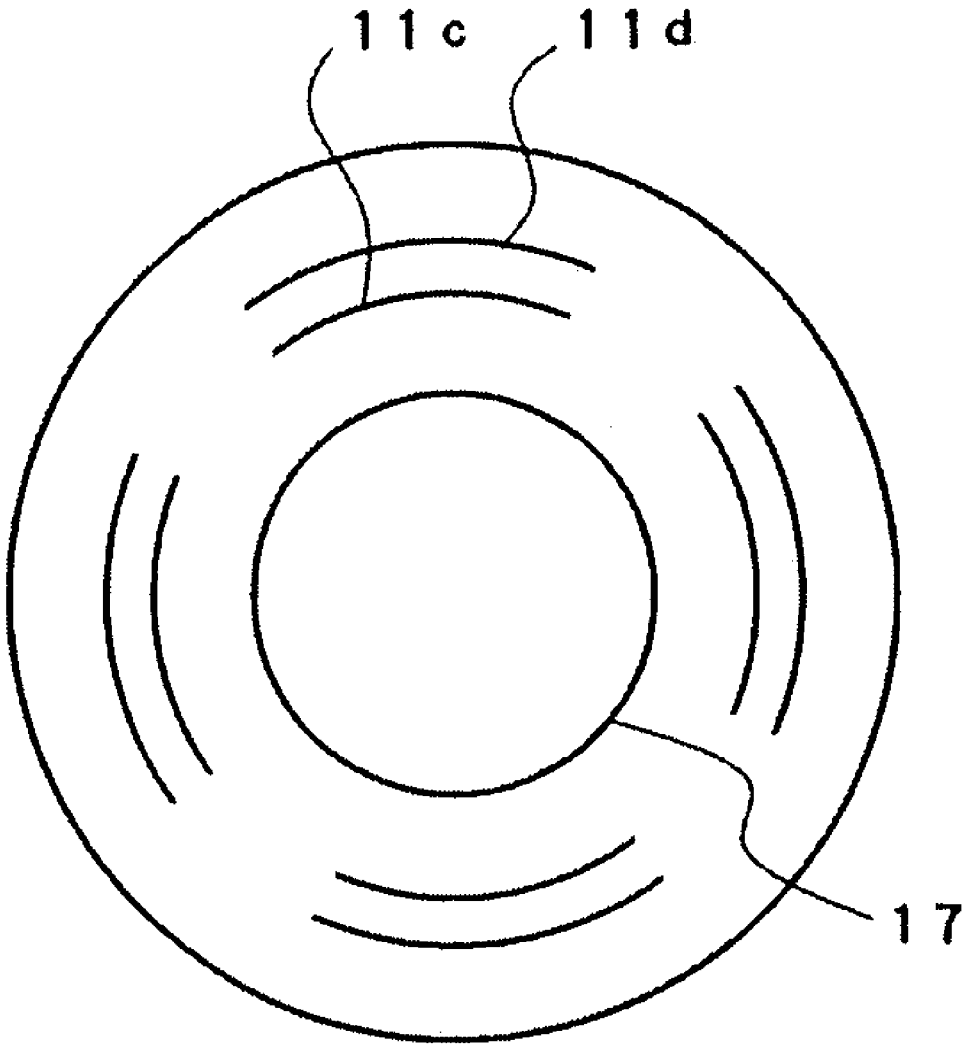

SPEAKER DEVICE

TECHNICAL FIELD

The present invention relates to a dynamic type speaker provided with a drive cone and a diaphragm which are integrally driven by a voice coil and, more particularly, to a speaker device in which the rigidity of the diaphragm in a vibration direction can be further enhanced, and further, the durability of each of the drive cone and the diaphragm can be enhanced.

BACKGROUND ART

In a dynamic type speaker, a voice coil bobbin having a voice coil wound therearound is basically fixed at an inner circumferential edge of a cone diaphragm whereas a peripheral edge of the diaphragm is secured to a frame via an edge portion. Moreover, a circumferential edge of a damper is fixed to the voice coil bobbin whereas a peripheral edge of the damper is secured to the frame. That is to say, the edge portion or the damper constitutes a suspension in a vibration system such as the diaphragm or the voice coil.

A deep bass reproducing speaker which is called a woofer or a sub woofer for use in, for example, a vehicle-mounted audio system is configured such that a satisfactory sound pressure level in a bass region can be ensured by taking a great amplitude stroke of the diaphragm since there is a limitation on a diameter of a diaphragm.

The damper, in particular, constituting the above-described suspension in the vibration system need be equipped with a function for ensuring an amplitude stroke equal to that at the edge portion without any contact of the voice coil with a pole piece or a yoke constituting a magnetic gap.

As a consequence, it is difficult to give great compliance to the damper. There arises a problem of degradation of power linearity caused by the occurrence of non-linearity of a movable load in the damper in the speaker in which the great amplitude stroke is ensured. In addition, there is carried a problem that a mechanical fatigue of the damper occurs earlier than that of the edge portion.

In the meantime, a corrugation damper having a bellows shape in a cross section is frequently used as the damper in order to ensure the compliance. However, there arises a problem that peculiar vibrations or scratchy noises occur due to deformation between adjacent bellows accompanied with an amplitude motion. This prominently occurs in the speaker having the great amplitude stroke of the diaphragm, as described above.

In view of this, the Applicant has already filed the application of a speaker device in which, for example, a rolled edge having a function similar to that of the above-described edge portion is adopted in place of the above-described damper, and further, the rigidity of the diaphragm in the vibration direction can be enhanced, as disclosed in the gazette of Patent Document 1.

With a configuration of the speaker disclosed in Patent Document 1, it is possible to solve the problems experienced by the use of the above-described damper, and further, to enhance the rigidity of the diaphragm in the vibration direction, thus achieving excellent acoustic characteristics as a bass reproducing speaker.

Patent Document 1: Japanese Patent Application Laid-open No. 2005-191746

DISCLOSURE OF INVENTION

Problems to be Solved by the Invention

The bass reproducing speaker disclosed in Patent Document 1 is configured such that the vibration caused by the voice coil movably disposed in the magnetic gap is transmitted to the drive cone, via which the diaphragm is driven. This configuration adopts means for joining (i.e., bonding) the diaphragm to the drive cone by using, for example, an adhesive agent.

A bonded surface between the drive cone and the diaphragm is formed substantially in parallel to a surface perpendicular to the vibration direction of the drive cone and the diaphragm in the speaker disclosed in Patent Document 1. Therefore, the speaker of this type accompanied with the great amplitude generated in the diaphragm suffers from a problem that the portion is liable to be peeled off with poor durability. That is to say, in the case where the drive cone and the diaphragm are peeled off from each other, an abnormal noise on a high level occurs at the peeled-off portion, thereby inducing a critical result for the speaker of this type.

In the meantime, Patent Document 1 is directed to a thin speaker as a whole, and therefore, a sufficient rigidity in the vibration direction cannot be satisfactorily exhibited in an integral structure constituted of the drive cone and the diaphragm, in particular. This point is susceptible to improvement.

In a closed space defined by the frame, the drive cone, the diaphragm, and the edge portion, repeated motions of compression and expansion accompanied by the vibration of the diaphragm break the joint between the drive cone and the diaphragm, thereby inducing another critical problem that a sound cannot be reproduced.

The present invention is directed to solve the above-described problems. In other words, the present invention is suitable for, in particular, a speaker device accompanied with the high amplitude in the diaphragm, as described above, and therefore, its objects are to provide a speaker device in which the rigidity of the drive cone and the diaphragm in the vibration direction can be further enhanced, and a speaker having enhanced durability, which can reduce the frequency of occurrence of peeling-off between the drive cone and the diaphragm.

Means for Solving the Problems

In order to solve the above-described problems, a preferred basic mode of a speaker device according to the present invention, according to claim 1, is featured by a speaker device which is provided with a drive cone and a diaphragm integrally driven by a voice coil movably disposed in a magnetic gap and in which peripheral edge portions of the drive cone and the diaphragm are supported by a frame via different edge portions, the speaker device characterized in that: a rising-up portion which rises up toward an acoustic radiation direction from an inner circumferential end of the drive cone, and a rising-down portion which reversely rises down toward a direction reverse to the acoustic radiation direction continuously to and outward of the rising-up portion are formed on the drive cone; and at a top formed between the rising-up portion and the rising-down portion on the drive cone, an inner circumferential end of the diaphragm is fixed to the drive cone, and further, a first rib and a second rib outside of the first rib are formed on the rising-down portion in the drive cone integrally with the drive cone toward the acoustic radiation direction, a back side of the diaphragm being secured at each of the tips of the first rib and the second rib.

In this case, in one preferred mode, the first rib and the second rib are formed concentrically with each other, as viewed in the acoustic radiation direction, and further, are formed in a state in which they are separated into a plurality of arcs.

With the speaker device having the above-described configuration, the top is formed, in the drive cone, between the rising-up portion which rises up at an acute angle toward the acoustic radiation direction from the tip at the inner circumferential edge (hereinafter referred to as an inner circumferential end) of the drive cone and the rising-down portion which rises down toward a direction reverse to the acoustic radiation direction. Moreover, the top has the groove, and further, the drive cone supports the diaphragm in the state in which the projection formed at the inner circumferential end of the diaphragm is inserted into the groove, thereby enhancing the rigidity in the vibration direction of the diaphragm. As a consequence, the drive cone and the diaphragm supported by the drive cone can be vibrated integrally with each other with the application of drive force of the voice coil, and thus, can be suitably adopted in, particularly, a speaker accompanied with a large amplitude in the diaphragm.

BRIEF DESCRIPTION OF THE DRAWINGS

FIG. 1 is a partial cross-sectional view showing a speaker device in a first embodiment according to the present invention;

FIG. 2 is an enlarged cross-sectional view showing mainly a drive cone, in particular, in the speaker device shown in FIG. 1;

FIG. 3 is a cross-sectional view showing a second embodiment in which configurations of a drive cone and a diaphragm are partly varied;

FIG. 4 is a cross-sectional view showing a third embodiment in which a configuration of a drive cone is partly varied;

FIG. 5 is a partial cross-sectional view showing a speaker device in a fourth embodiment according to the present invention;

FIG. 6 is a partial cross-sectional view showing a speaker device in a fifth embodiment according to the present invention;

FIG. 7 is a plan view exemplifying arrangement of a rib with respect to a drive cone;

FIG. 8 is a plan view exemplifying another arrangement of the rib with respect to the drive cone; and FIG. 9 is a plan view exemplifying a further arrangement of the ribs with respect to the drive cone.

EXPLANATION OF REFERENCE NUMERALS

1 pole yoke
2*a*, 2*b* magnet
3 plate
4 sub plate
5 magnetic gap
6 voice coil
7 voice coil bobbin
11 drive cone
11*c* first rib
11*d* second rib
11*f* diaphragm fixing surface
11*g* first groove
11*h* second groove
11*i* third groove
11*m* joint surface
11*n* diaphragm fixing surface
12 frame
13 edge portion
14 diaphragm
14*a* first projection
14*b* second projection
14*c* third projection
14*h* rising-up surface
15 edge
16 gasket
17 center cap
A closed space

BEST MODE FOR CARRYING OUT THE INVENTION

Hereinafter, a speaker device according to the present invention will be described in the embodiments shown in the drawings. An obverse and a back side described hereinafter are defined as an acoustic radiation side and a side reverse to the acoustic radiation side, respectively. FIG. 1 shows a first embodiment, being a cross-sectional view showing a right half on a center line in the speaker device. Reference numeral 1 designates a pole yoke having a central portion formed into a hollow shape. Ring-like magnets 2*a* and 2*b* are disposed coaxially with a cylindrical portion 1*b* of the pole yoke in such a manner that the pole yoke 1 is mounted on a disk-like flange 1*a* formed integrally with a bottom of the pole yoke 1.

Upper surfaces of magnets 2*a* and 2*b* are disposed a ring-like plate 3 and a ring-like sub plate 4 in such a manner as to be fitted to an inner circumferential surface of the plate 3. With the above-described configuration, a magnetic gap 5 is formed between an inner circumferential surface of the ring-like sub plate 4 and a peripheral surface of the pole yoke 1 (i.e., a peripheral surface of the cylindrical portion 1*b*).

To the magnetic gap 5 is movably fixed a cylindrical voice coil bobbin 7 having a voice coil 6 wound therearound along a longitudinal direction of the pole yoke 1 (i.e., in a vertical direction in FIG. 1). Moreover, at a peripheral surface in the vicinity of an upper end of the voice coil bobbin 7 is fixed a ring member 8, which forms an inversed L shape (a cross-sectional shape) by forming a wall surface upward so as to form a U-shaped sump for an adhesive agent between the voice coil bobbin 7 and the same.

An inner circumferential end of a drive cone 11 (i.e., a tip of an inner circumferential edge of the drive cone 11) is inserted into the U-shaped portion formed between the ring member 8 and the voice coil bobbin 7, and further, an inner circumferential end of the drive cone 11 is joined to a peripheral surface of the voice coil bobbin 7 via an adhesive agent (not shown) impregnated into the U-shaped portion. The drive cone 11 is made of, for example, a synthetic resin material and molded into a substantially cylindrical shape as a whole, and further, includes a rising-up portion 11*a*, which rises up at an acute angle toward an acoustic radiation direction from the inner circumferential end thereof, and a rising-down portion 11*b*, which rises down toward a direction reverse to the acoustic radiation direction.

At the surface of the rising-down portion 11*b* on the drive cone 11 are formed two ribs 11*c* and 11*d* integrally with each other toward the acoustic radiation direction (in a direction from the surface of the drive cone 11 toward the back side of a diaphragm, described later, that is, upward in FIG. 1). In the embodiment, the rib formed near the rising-up portion 11*a* on the drive cone 11 is referred to as a first rib 11*c* whereas the rib formed near an edge portion 13 is referred to as a second rib 11*d*.

A peripheral end of the drive cone 11 (i.e., a tip of a peripheral edge of the drive cone 11) is formed into a flange shape. Between the flange lie and a frame 12 is interposed the roll-like edge portion 13. That is to say, the drive cone 11 is supported by the frame 12 in such a manner as to become drivable in the acoustic radiation direction via the roll-like edge portion 13.

In the meantime, grooves are formed along the annular top formed between the rising-up portion 11*a* and the rising-down portion 11*b* on the drive cone 11 and the tips of the first rib 11*c* and the second rib 11*d*. The drive cone 11 is fixed to a back side of a diaphragm 14 via an adhesive agent (not shown) injected into the grooves. A structure for fixing the diaphragm 14 to the drive cone 11 will be described later in detail in reference to FIG. 2.

A peripheral edge of the diaphragm 14 is supported at an opening edge of the frame 12 via a wedged-shaped edge 15. Here, reference numeral 16 designates a gasket for holding a peripheral edge of the wedged-shaped edge 15 at the opening edge of the frame 12.

The diaphragm 14 in the embodiment is concentrically formed. In the vicinity of an inner circumferential edge of the diaphragm 14 is fixed a center cap 17 occupying a relatively large area. That is to say, a peripheral edge of the center cap 17 is bent toward the rising-down portion 11*b* of the drive cone 11, intrudes into the groove formed on the diaphragm 14, and then, is fixed to the diaphragm 14 at the groove via the adhesive agent (not shown). A structure for fixing the center cap 17 to the diaphragm 14 also will be described later in detail in reference to FIG. 2.

The wedged-shaped edge 15 supporting the diaphragm 14 at the peripheral edge of the diaphragm 14 is constituted of a first region 15*a* whose crest is high and which is widely formed, and a second region 15*b* whose crest is lower than the height of the crest of the first region 15*a* and which is narrowly formed on the side of the frame 12 with respect to the first region 15*a*. With this constitution, the wedged-shaped edge constituting the first region 15*a*, in particular, can secure a greater compliance, and therefore, it can operatively follow the diaphragm 14 even if the diaphragm 14 is largely driven.

In the speaker device having the above-described configuration, it is desirable that a space surrounded by the wedged-shaped edge 15, the diaphragm 14, the drive cone 11, the edge portion 13 and the frame 12, as indicated by reference character A, should be defined in a closed state. Air staying inside of the closed space A acts as an air spring in such a manner that the diaphragm 14 via the drive cone 11 is driven integrally with the drive cone 11.

FIG. 2 is an enlarged cross-sectional view showing mainly the drive cone, in particular, in the speaker device shown in FIG. 1, in explaining the structure for fixing the diaphragm 14 to the drive cone 11.

At the annular top formed between the rising-up portion 11*a* and the rising-down portion 11*b* on the drive cone 11, a fixing surface 11*f* for the diaphragm is formed substantially in parallel to a surface perpendicular to the vibration direction of the drive cone, as shown in FIG. 2. An inner circumferential edge 14*d* of the diaphragm 14 is fixed at the back side thereof to the fixing surface 11*f* via the adhesive agent (not shown).

On an extension of the fixing surface 11*f*, that is, between the fixing surface 11*f* and the rising-down portion 11*b* is further formed a groove 11*g* (also referred to as a first groove) along the fixing surface 11*f*. A projection (also referred to as a first projection) 14*a* formed at the back side of the inner circumferential edge of the diaphragm 14 in such a manner as to project toward the drive cone 11 is fixed to the drive cone 11 via the adhesive agent (not shown) in a state in which the projection 14*a* is inserted into the groove 11*g*.

Moreover, at the respective tips of the first rib 11*c* and the second rib 11*d* formed in the drive cone 11 are formed grooves 11*h* and 11*i* (also referred to as a second groove and a third groove, respectively) along the tips.

A projection (also referred to as a second projection) 14*b* formed on the diaphragm 14 in such a manner as to project toward the drive cone 11 is fixed via the adhesive agent (not shown) in a state in which the projection 14*b* is inserted into the groove 11*h* formed at the tip of the first rib, and further, a projection (also referred to as a third projection) 14*c* formed nearer the wedged-shaped edge 15 than the second projection 14*b* is fixed via the adhesive agent (not shown) in a state in which the projection 14*c* is inserted into the groove 11*i* formed at the second rib.

As described above, in the embodiment shown in FIG. 1 and FIG. 2, the first, second and third projections 14*a*, 14*b* and 14*c* are formed on the diaphragm 14 in such a manner as to project toward the drive cone 11, and further, are fixed via the adhesive agent (not shown) in the state in which the first to third projections are inserted into the first groove 11*g* formed at the top of the drive cone 11 and the second and third grooves 11*h* and 11*i* formed at the tips of the ribs 11*c* and 11*d*, respectively.

In the meantime, to the above-described diaphragm 14 is fixed the peripheral edge of the center cap 17, as described above. A groove 14*e* is formed on the diaphragm 14. The center cap 17 is fixed to the diaphragm 14 in a state in which a bent portion 17*a* formed at the peripheral edge of the center cap 17 is inserted into the groove 14*e*.

Here, the adhesive agent (not shown) should be preferably filled into the groove 14*e* formed on the diaphragm 14, so that the center cap 17 and the diaphragm 14 are joined to each other, thereby achieving a satisfactory mechanical strength.

At a position of the diaphragm 14 corresponding to the bent portion 17*a* of the center cap, the second projection 14*b* formed on the diaphragm 14 is inserted into the groove 11*h* formed at the first rib 11*c* in the drive cone 11, to be fixed via the adhesive agent (not shown). As a consequence, the center cap 17 is driven in the vibration direction of the voice coil together with the diaphragm 14 disposed in such a manner as to surround the center cap, thus securing a satisfactory sound pressure level in the bass region.

Consequently, with the above-described speaker structure, a part of the diaphragm 14 is joined at the top of the drive cone 11, and further, is joined also to the first rib 11*c* and the second rib 11*d* formed on the drive cone 11, thus further enhancing the rigidity in the vibration direction. Additionally, a high amplitude can be given to the diaphragm.

In addition, the diaphragm 14 is bonded to the drive cone 11 in the state in which the first, second and third projections 14*a*, 14*b* and 14*c* formed on the back side of the diaphragm 14 are inserted into the first, second and third recesses 11*g*, 11*h* and 11*i* formed on the drive cone 11, respectively, thereby remarkably reducing the frequency of occurrence of an inconvenience such as peeling-off of the diaphragm 14 from the drive cone 11. In this way, the speaker device excellent in durability can be provided.

FIG. 3 shows a speaker device in a second embodiment according to the present invention. FIG. 3 illustrates mainly a structure for fixing a diaphragm 14 to a drive cone 11, like FIG. 2 illustrated already. Here, in FIG. 3, typical parts exhibiting the same functions as those shown in FIG. 2 are designated by the same reference numerals, and therefore, their detailed explanation will be omitted below.

In the embodiment shown in FIG. 3, a step 14*g* is formed on the diaphragm 14, and further, a bent portion 17*a* formed toward the diaphragm 14 at a peripheral edge of a center cap 17 is joined along a rising-up surface 14*h* having the step 14*g*. The bent portion 17*a* of the center cap 17 and the rising-up surface 14*h* of the diaphragm 14 are fixed substantially in parallel to a vibration direction via an adhesive agent (not shown).

In the meantime, in the embodiment shown in FIG. 3, a joint surface 11*m* to be joined to a third projection 14*c* formed from the diaphragm 14 is formed on an inside surface of a tip of a second rib lid formed on the drive cone 11, and is formed substantially in parallel to the vibration direction of the drive cone 11.

Specifically, a joint surface 11*m* is formed at the tip of the second rib 11*d* in such a manner as to face the third projection 14*c* formed from the diaphragm 14. The joint surface 11*m* is formed substantially in parallel to the vibration direction of the drive cone 11. The third projection 14*c* from the diaphragm 14 is fixed at the joint surface 11*m* formed on the rib 11*d* via the adhesive agent (not shown).

Moreover, with the configuration shown in FIG. 3, the step 14*g* is formed on the diaphragm 14, and further, the center cap 17 is fixed to the diaphragm 14 in the state in which the bent portion 17*a* formed at the peripheral edge of the center cap 17 is joined along the rising-up surface 14*h* having the step 14*g*. That is, with the configuration shown in FIG. 3, the bent portion 17*a* formed at the center cap 17 is fixed to the diaphragm 14 at the rising-up surface 14*h* formed on the diaphragm 14, and therefore, a necessary and adequate fixing strength can be achieved. Moreover, in the speaker structure shown in FIG. 3, the joint surface ll*m* corresponding to the third projection 14*c* from the diaphragm 14 in the second rib ll*d* is formed substantially in parallel to the vibration direction of the drive cone 11, and therefore, a necessary and adequate fixing strength can be achieved against the peeling-off of the diaphragm even in the case of the application of the vibration.

Incidentally, the embodiment shown in FIG. 3 is configured such that the joint surface 11*m* corresponding to the third projection 14*c* from the diaphragm 14 is formed at the tip of the second rib 11*d*. Alternatively, there may be adopted a structure having a joint surface to be fixed substantially in parallel to the vibration direction in a manner corresponding to the rising-up surface 14*h* also in a first rib 11*c*.

FIG. 4 shows a speaker device in a third embodiment according to the present invention. FIG. 4 illustrates mainly a structure for fixing a diaphragm to a drive cone, like FIG. 2 illustrated already. Here, in FIG. 4, typical parts exhibiting the same functions as those shown in FIG. 2 are designated by the same reference numerals, and therefore, their detailed explanation will be omitted below.

The embodiment shown in FIG. 4 is configured such that a fixing surface 11*n* of a diaphragm 14 formed at a tip of a first rib 11*c* formed on a drive cone is formed substantially in parallel to a surface perpendicular to a drive direction of a drive cone 11, and further, the diaphragm 14 is fixed to the fixing surface 11*n* via an adhesive agent (not shown).

Also with the configuration shown in FIG. 4, the diaphragm 14 can have a necessary and adequate fixing strength with respect to the drive cone 11 in cooperation with other fixing means such as a second rib 11*d*. The configuration of the fixing surface 11*n* of the diaphragm shown in FIG. 4 may be adopted as the second rib 11*d* in the same manner.

Besides the configurations of the speaker device shown above in FIGS. 1 to 4, there may be configurations shown in FIGS. 5 and 6.

In FIG. 5, two projections formed on a back side of a diaphragm are inserted into two grooves formed on a surface of a drive cone, so that the drive cone and the diaphragm are joined to each other. In addition, it is possible to prevent the drive cone and the diaphragm from being peeled off from each other by forming a claw at one of the projections of the diaphragm.

In FIG. 6, a projection formed on a surface of a drive cone is inserted into a groove formed on a back side of a diaphragm, so that the drive cone and the diaphragm are joined to each other. In the same manner, projections formed at a first rib and a second rib are inserted into grooves formed on the back side of the diaphragm, so that the first rib and the second rib are joined to the diaphragm, that is, the drive cone supports the diaphragm via the first rib and the second rib.

In the meantime, as for the drive cone shown in FIGS. 1 to 6, a boundary portion (hereinafter referred to as a bent portion) having a large inclination to a small inclination in rising up is formed to the top from the rising-up portion 11*a*. Thanks to such a shape of the drive cone, the rising-up portion 11*a* having the large inclination can be formed from the inner circumferential end of the drive cone to the bent portion, so that the vibration can be efficiently transmitted from the voice coil to the drive cone, and further, to the diaphragm more than a speaker device provided with the drive cone having no bent portion and the diaphragm.

As for the first and second ribs shown in FIGS. 1 to 6, the arrangement at the surface of the drive cone may be annular, elliptical or polygonal in such a manner as to surround the inner circumferential edge of the drive cone 11. Although the first and second ribs are different from each other in the above-described embodiments, they may be connected to each other. Otherwise, for example, a cross section of a rib cut in a direction perpendicular to an acoustic radiation direction, as shown in FIG. 7, may be substantially arcuate, or the plurality of ribs may be circumferentially arranged in such a manner as to surround the inner circumferential edge of the drive cone. Arrangements shown in FIGS. 8 and 9 are exemplified, and further, they are not limited.

As for the drive cone 11, the first and second ribs may not be molded integrally with each other, and further, they are not limited. In the case where, in particular, the first and second ribs are molded integrally with the drive cone 11, it is desirable that a first rib 11*c* and a second rib ll*d* should be formed concentrically with each other, and further, should be split into a plurality of arcs, as viewed in the acoustic radiation direction, as shown in FIG. 9. With this configuration, it is possible to enhance the entire rigidity of the drive cone 11, and to suppress the joint of the drive cone 11 to the diaphragm 14 from being broken even if a drive operation of a large stroke acts on the drive cone 11, so as to prevent any generation of a critical problem that a sound cannot be reproduced.

The above-described integral molding can be conducted by a known method. For example, the drive cone 11 can be molded integrally with the first and second ribs by injection molding.

The invention claimed is:

1. A speaker device comprising a drive cone and a diaphragm integrally driven by a voice coil movably disposed in a magnetic gap and in which peripheral edge portions of the drive cone and the diaphragm are supported by a frame via different edge portions, the speaker device characterized in that the drive cone comprises:

a rising-up portion which rises up toward an acoustic radiation direction from an inner circumferential end of the drive cone, and a rising-down portion which reversely rises down toward a direction reverse to the acoustic radiation direction outward of the rising-up portion and away from the inner circumferential end of the drive cone, wherein the rising-up portion and the rising-down portion form a continuous line; and an inner circumferential end of the diaphragm is fixed to the drive cone at a top formed between the rising-up portion and the rising-down portion of the drive cone, and further, a first rib and a second rib outside of the first rib are formed integrally with the rising-down portion of the drive cone toward the acoustic radiation direction, a back side of the diaphragm being secured at each of tips of the first rib and the second rib.

2. The speaker device characterized in that the first rib and the second rib are formed concentrically with each other, as viewed in the acoustic radiation direction, and further, are formed in a state in which they are separated into a plurality of arcs.

3. The speaker device according to claim 1, characterized in that a groove is formed at and along the tip of the first rib formed on the drive cone, a projection is formed by the diaphragm toward the drive cone, and the diaphragm is fixed to the drive in a state in which the projection formed on the diaphragm is inserted into the groove formed at the first rib.

4. The speaker device according to claim 1, characterized in that a projection is formed at and along the tip of the first rib formed by the drive cone, a groove is formed on the diaphragm toward the drive cone, and the diaphragm is fixed to the drive cone in a state in which the projection formed on the first rib is inserted into the groove formed on the diaphragm.

5. The speaker device according to claim 1, characterized in that the groove is formed on the surface of the diaphragm, and further, the center cap is fixed to the diaphragm in a state in which a bent portion formed at the peripheral edge of the center cap is inserted along the groove.

6. The speaker device according to claim 1, characterized in that a step is formed on the surface of the diaphragm, and further, the center cap is fixed to the diaphragm in a state in which a bent portion formed at the peripheral edge of the center cap is attached along the rising-up surface having the step.

7. The speaker device according to claim 1, characterized in that a joint surface, at which a side surface of the tip of the second rib formed by the drive cone and the projection formed on the diaphragm are joined to each other, is formed, the joint surface being formed substantially in parallel to the vibration direction of the drive cone.

8. The speaker device according to claim 1, characterized in that a fixing surface for the diaphragm is formed at the tip of the first rib substantially in parallel to a surface perpendicular to the vibration direction of the drive cone, the fixing surface having a back side of the diaphragm secured thereto.

9. The speaker device according to claim 2, characterized in that a space surrounded by the drive cone, the edge of the drive cone, the diaphragm, the edge of the drive cone and the frame forms a closed space.

10. The speaker device according to claim 2, characterized in that a space surrounded by the drive cone, the edge of the drive cone, the diaphragm, the edge of the drive cone and the frame forms a closed space.

11. The speaker device according to claim 2, characterized in that a space surrounded by the drive cone, the edge of the drive cone, the diaphragm, the edge of the drive cone and the frame forms a closed space.

12. The speaker device according to claim 2, characterized in that a space surrounded by the drive cone, the edge of the drive cone, the diaphragm, the edge of the drive cone and the frame forms a closed space.

13. The speaker device according to claim 2, characterized in that a space surrounded by the drive cone, the edge of the drive cone, the diaphragm, the edge of the drive cone and the frame forms a closed space.

14. The speaker device according to claim 2, characterized in that a space surrounded by the drive cone, the edge of the drive cone, the diaphragm, the edge of the drive cone and the frame forms a closed space.

15. The speaker device according to claim 2, characterized in that a space surrounded by the drive cone, the edge of the drive cone, the diaphragm, the edge of the drive cone and the frame forms a closed space.

16. The speaker device according to claim 2, characterized in that a space surrounded by the drive cone, the edge of the drive cone, the diaphragm, the edge of the drive cone and the frame forms a closed space.

* * * * *